US005375521A

United States Patent [19]

Schuster

[11] Patent Number: 5,375,521

[45] Date of Patent: Dec. 27, 1994

[54] FORCED AIR DRYER FOR PRINTING DEVICE

[76] Inventor: Vladimir Schuster, 195 Hudson St., New York, N.Y. 10013

[21] Appl. No.: 63,143

[22] Filed: May 17, 1993

[51] Int. Cl.[5] ..... B41F 35/00

[52] U.S. Cl. ..... 101/424.1; 101/424.2

[58] Field of Search ..... 101/424.1, 424.2, 240, 101/232; 271/211

[56] References Cited

U.S. PATENT DOCUMENTS

| | | | |
|---|---|---|---|
| Re. 16,779 | 11/1927 | Maxner | 271/211 |
| 1,107,859 | 8/1914 | Stevens | 271/211 |
| 1,140,157 | 5/1915 | Hodgman | 271/211 |
| 1,465,385 | 8/1923 | White | 271/211 |
| 1,743,921 | 1/1930 | Kerley | 271/211 |
| 2,110,218 | 3/1938 | Green et al. | 101/424.1 |
| 2,110,219 | 3/1938 | Green et al. | 101/424.1 |
| 2,626,801 | 1/1953 | Uriell | 271/211 |
| 3,085,143 | 3/1960 | Antoncich | 101/424.1 |
| 3,556,519 | 1/1971 | Keller | 271/211 |
| 4,132,400 | 1/1979 | Naramore | 271/211 |
| 5,239,613 | 8/1993 | Motev et al. | 101/424.1 |

*Primary Examiner*—Edgar S. Burr
*Assistant Examiner*—Anthony H. Nguyen
*Attorney, Agent, or Firm*—Mathews, Woodbridge & Collins

[57] ABSTRACT

This invention relates to a novel apparatus and method for preventing offsetting in a stack of sheets from a printer device. Air is directed towards the sheets of paper at which offset occurs. Preferably, a nozzle directs air to about 100 to about 200 sheets of the stack. The apparatus can be used with a high speed printing device without interrupting the operation of the printing device.

7 Claims, 2 Drawing Sheets

FORCED AIR DRYER FOR PRINTING DEVICE

BACKGROUND OF THE INVENTION

1. Field of the Invention

This invention relates to a system for preventing freshly printed sheets of a high speed printing device from offsetting.

2. Description of the Related Art

The American Heritage Dictionary defines "offset" as the unintentional or faulty transfer of ink not yet dry from a printer sheet to a surface, such as the next sheet that is laid over it. Offset is typically produced by the piling of sheets upon one another after imprinting. U.S. Pat. No. 2,110,219 describes a method for preventing offset in printing which a spray of a cloud of solvent material is applied to the freshly printed sheet. The solvent can be formed of lacquer gums, resin, cellulose esters or ethers which are soluble in alcohol, acetone or other solvents. A nozzle applies the cloud to the entire sheet of paper. A stack is formed of the treated sheets.

U.S. Pat. No. 3,556,519 describes a method and apparatus for stacking paper. A stream of compressed air is blown by nozzles below each successive sheet as the sheet advances from the printing unit to a collecting station. The air stream contains communicated solid material which is deposited to the underside of each advancing sheet. The above-described patents have the shortcoming of requiring the application of a solvent material to the printed sheets of paper.

U.S. Pat. No. 1,140,157 relates to a sheet piling mechanism for preventing freshly printing sheets from offsetting. Air is discharged intermittently towards the top freely dropping sheet. A nozzle moves in and out of the path of the piling sheets for temporarily supporting the uppermost sheet. The teachings of this patent have the disadvantage that the movement of the nozzle would undesirably interrupt the flow of sheets if used with a high speed printer.

Of possible general relevance are U.S. Pat. No. 4,132,400 to an apparatus for aligning a stack of sheets; No. 1,743,521 to a method of drying freshly printed sheets; and No. 1,465,385 to a sheet delivering mechanism.

It is desirable to provide an apparatus to prevent offsetting without interruption of high speed printing devices.

SUMMARY OF THE INVENTION

Briefly described, the prevent invention comprises an apparatus and method for preventing offseting on sheets from a printing device without interruption of the printer device. It has been found that offset printing occurs when weight is applied to the surface of a printed sheet by numerous sheets of paper which are stacked thereon. Thus, offset occurs in the middle portion of the stack of printed sheets. In the present invention, air is directed towards the sheets of paper in the stack at which offset occurs.

A nozzle is used to direct air to the middle portion of the stack at which offset occurs. Preferably, the nozzle directs air to about 100 to 200 sheets in the stack. The apparatus of the present invention can be used with a high speed printer which can print up to 13,000 sheets per hour.

The invention may be more fully understood by reference to the following drawings.

DETAILED DESCRIPTION OF THE INVENTION

During the course of this description like numbers will be used to identify like elements according to the different figures which illustrate the invention.

Figure 1:
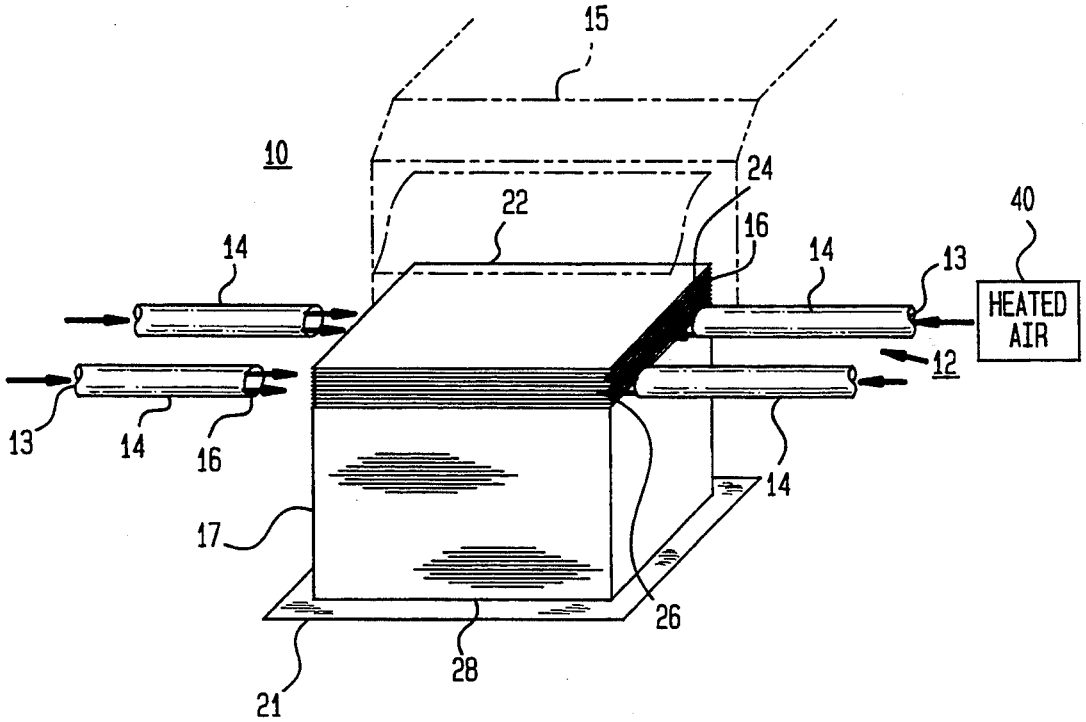
FIG. 1 is a front elevational view of the apparatus for preventing offset printing in accordance with the present invention.

FIG. 1 illustrates a front elevational view of an apparatus for preventing offset printing 10 in accordance with the teachings of the present invention. Printing device 15 prints an image on a sheet of paper 22. Sheets of paper 22 are accumulated into a stack 28 on tray 21. Printing device 15 can be a conventional high speed printing device which can print at least 1,000 and up to 13,000 sheets per hour as is known in the art. For example, the printing device can be manufactured by Heidelberg as the Speedmaster.

Stack 28 is formed of a top portion 24 and a middle portion 26 positioned below top portion 24. Top portion 24 can be defined as having a width in the range of about 0.5 to about 2.5 inches. Preferably, top portion 24 has a width of at least one inch. Stack 28 has a pair of side portions 17 positioned on either side of stack 28.

Offset occurs when numerous sheets 22 are pressed together under sufficient weight of top sheets. Offset will occur in middle portion 26 under weight of the sheets in top portion 24. Offset will not occur in sheets of top portion 24 since there are not enough sheets in top portion 24 to provide sufficient weight for producing offset. Offset is prevented by directing air towards middle portion 26 of stack 28. Preferably, middle portion 26 is about 100 to about 200 sheets.

System 12 directs air towards side portions 17 of stack 28. System 12 includes at least one tube 14. Air enters end 13 of tube 14 and exits end 16. Tube 14 is positioned adjacent middle portion 26 of stack 28 for directing air towards middle portion 26 of stack 28.

Figure 2:
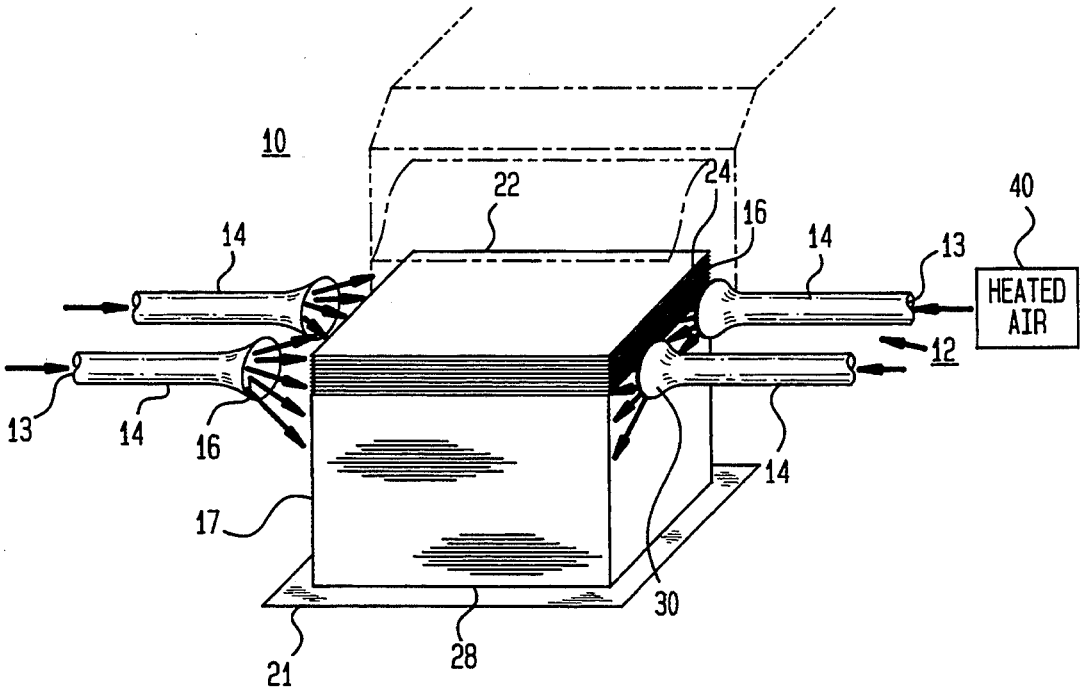
FIG. 2 is a front elevational view of the apparatus shown in FIG. 1 including air directing nozzles.
Figure 3:
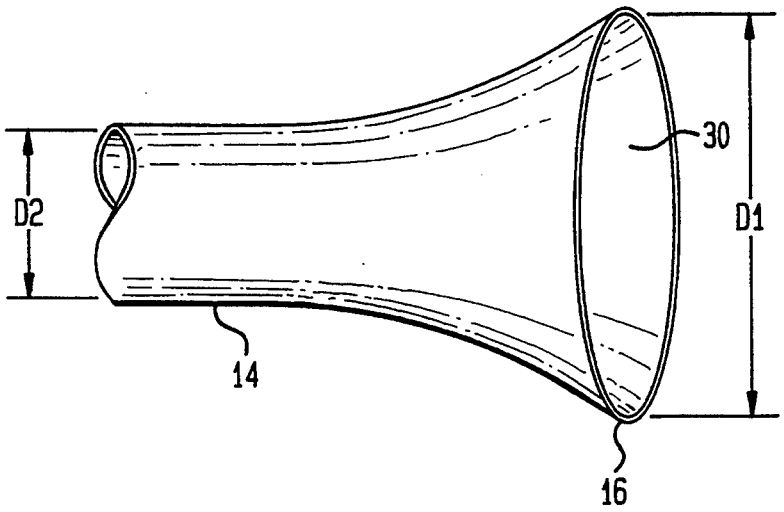
FIG. 3 is a side elevational view of the air directing nozzle used in the present invention.

FIG. 2 illustrates a front elevational view of the system for preventing offset printing 12 including nozzle 30 mounted to end 16 of tube 14. Nozzle 30 has a diameter $D_1$ which is larger than diameter $D_2$ of the tube 14, as shown in FIG. 3. Preferably, nozzle 30 directs air toward a width of about 1.0 to about 5 inches of middle portion 26 for directing air towards about 100 to about 200 sheets. An air cushion is formed between adjacent sheets in middle portion 26.

Heating means 40 can be used for providing heated air to tube 14. Heated air expeditiously dries sheets 22 for improved prevention of offset between adjacent sheets. Preferably, heating means 40 heats the air to a temperature of greater than ambient air and less than 110° F.

The present invention provides the advantage of preventing offset printing at the location at which offset occurs in a stack of sheets from a high speed printing device. Preferably, air is directed towards about 100 to about 200 sheets in the stack. Air is directed to the location at which offset occurs during the operation of the high speed printing device. A heater can be used for heating the air for expeditiously drying the sheets. Accordingly, the present invention prevents offset printing without interruption of the high speed printer.

While the invention has been described with reference to the preferred embodiment thereof, it will be appreciated by those of ordinary skill in the art that modifications can be made to the structure and form of the invention without departing from the spirit and scope thereof.

I claim:

1. An apparatus for preventing offset printing on sheets printed by a high speed printing device which prints up to 13,000 sheets per hour comprising:

means for receiving paper from said printing device and for forming a stack of paper, said stack having a top portion, a middle portion positioned below said top portion, and side portions on either side of said stack, said middle portion including about 100 to about 200 sheets of said sheets; and means for directing air toward said middle portion of said stack from said side portions, said means for directing air including a plurality of tubes, each of said tubes ending in a circular nozzle which gradually increases in diameter as it approaches said sheets thereby preventing offsetting of said stack of paper.

2. The apparatus of claim 1 wherein said top portion has a width of at least one inch.

3. The apparatus of claim 2 further comprising:

heating means for heating said air before said air is directed toward said stack, wherein said air is heated to a temperature of greater than ambient and less than 110° F.

4. A method for preventing offset in a highspeed printing device, said high speed printing device prints up to 13,000 sheets per hour comprising the steps of:

aligning sheets of paper from said printing device for forming a stack of said sheets, said stack having a top portion, a middle portion positioned below said top portion, and side portions positioned on either side of said stack, said middle portion including about 100 to 200 of said sheets; and providing a plurality of tubes, each of said tubes ending in a circular nozzle which gradually increases in diameter as it approaches said sheets, directing air toward said middle portion of said stack has been inserted after thereby preventing offsetting of said stack of paper.

5. The method of claim 4 wherein said air is directed to said side portions of said stack.

6. The method of claim 5 further comprising the step of:

heating said air before the step of directing said air toward said stack.

7. The method of claim 6 wherein said top portion has a width of at least one inch.

* * * * *